United States Patent [19]

Miyamoto et al.

[11] 4,330,493

[45] May 18, 1982

[54] PROCESS FOR PREPARING A HIGH VOLTAGE IGNITION CABLE HAVING LOW ELECTROSTATIC CAPACITY

[75] Inventors: Yoshimi Miyamoto, Kariya; Yasuo Toriumi; Keiichi Kojima, both of Osaka, all of Japan

[73] Assignees: Sumitomo Electric Industries, Ltd., Tokyo; Nippondenso Co., Ltd., Aichi, both of Japan

[21] Appl. No.: 234,061

[22] Filed: Feb. 13, 1981

[30] Foreign Application Priority Data

Feb. 13, 1980 [JP] Japan ..... 55-17114

[51] Int. Cl.[3] ..... H01B 0/00

[52] U.S. Cl. ..... 264/22; 427/118; 427/44; 338/214; 428/377; 428/379; 428/381; 428/383; 428/395; 264/174

[58] Field of Search ..... 428/389, 395, 377, 368, 428/372, 375, 379, 383, 381; 427/118, 117, 44; 264/22, 174; 338/214, 66

[56] References Cited

U.S. PATENT DOCUMENTS 3,701,863 10/1972 Willis ..... 427/44
3,725,230 4/1973 Bahder ..... 264/22
3,870,987 3/1975 Wiley ..... 427/118
3,911,202 10/1975 Stine ..... 427/44
4,226,687 10/1980 Sasski ..... 427/44

FOREIGN PATENT DOCUMENTS 766802 1/1957 United Kingdom ..... 264/22

*Primary Examiner*—Sam Silverberg
*Attorney, Agent, or Firm*—Sughrue, Mion, Zinn, Macpeak and Seas

[57] ABSTRACT

A process for preparing a high voltage-ignition cable having a low electrostatic capacity comprising a resistive-conductor core, an insulator layer and a jacket layer, which comprises preparing a resistive-conductor core comprising a fiber bundle and a semiconductive material provided on at least on the circumferential surface thereof, extrusion coating a polyolefin resin on the circumferential surface of the resistive-conductor core to form an insulator layer, irradiating the insulator layer with electron beam to effect cross-linking of the resin, extrusion coating a polyolefin resin, without providing a reinforcing layer or after providing a reinforcing layer, on the cross-linked insulator to form a jacket and irradiating the jacket with electron beam.

6 Claims, 2 Drawing Figures

PROCESS FOR PREPARING A HIGH VOLTAGE IGNITION CABLE HAVING LOW ELECTROSTATIC CAPACITY

BACKGROUND OF THE INVENTION

This invention relates to a process for preparing a high voltage ignition cable (hereinafter referred to as an "ignition cable") which is used to suppress radio interference generated by electrical ignition in an internal combustion engine, e.g., in a car, etc.

When conductive substances such as salts (e.g., for the prevention of freezing of roads in a cold district), sludge, etc., attach onto the external surface of a jacket of the ignition cable and the impedance thereof relative to the ground potential is lowered, the charged current flows out thereto according to the electrostatic capacity between a resistive conductor core (hereinafter referred to as a "core," for simplicity) and the external surface of the jacket.

Therefore, as the electrostatic capacity increases, a reduction in the ignition voltage increases, resulting in poor ignition. In order to eliminate such poor ignition, it is necessary to use an ignition cable having as low electrostatic capacity as 80 pF/m or less.

One way of lowering the electrostatic capacity is to increase the outer diameter of the ignition cable. However, increasing the outer diameter is not desirable, since the outer diameter of the ignition cable is usually about 7 or 8 mm, and the ignition cable obtained cannot be exchanged with conventional ones, and requires additional space.

One method of lowering the electrostatic capacity while maintaining the outer diameter of the ignition cable at a predetermined level is to reduce the outer diameter of the core. However, various problems arise when merely reducing the outer diameter of the core of the conventional arts.

Glass fiber bundles have heretofore been used conventionally as a tension member constituting the core. When the diameter of the core prepared using the glass fiber bundle is reduced to lower the electrostatic capacity of the ignition cable, the core may be cut in the course of extrusion or vulcanization of the insulator layer, jacket, or the like. This makes the commercial production of such an ignition cable difficult.

The above defect encountered in the use of the glass fiber bundle can be overcome by using an aromatic polyamide fiber bundle of high strength as a tension member of the core, and an ignition cable having a low electrostatic capacity of about 80 pF/m can be obtained.

It has been found, however, that the thus-obtained ignition cable of a low electrostatic capacity suffers from the disadvantage that its high voltage-withstanding ability is unstable, and it is insufficiently durable for long and repeated use.

SUMMARY OF THE INVENTION

An object of this invention is to provide a process for preparing an ignition cable which has a sufficiently low electrostatic capacity.

Another object of this invention is to provide a process for preparing an ignition cable having a sufficiently low electrostatic capacity and an excellent high voltage-withstanding ability, which is produced based upon the finding that when an insulator layer is prepared using a polyolefin resin and irradiated with electron beam the high voltage-withstanding ability is improved.

In this invention, a process for preparing a high voltage ignition cable having a low electrostatic capacity comprising a resistive-conductor core, an insulator layer and a jacket layer, is provided which comprises preparing a resistive-conductor core comprising a tension member consisting of a fiber bundle and a semiconductive material provided at least on the circumferential surface thereof, extrusion coating a polyolefin resin on the circumferential surface of the resistive conductor core to form an insulator layer irradiating the insulator layer with electron beam to effect cross-linking of the resin, extrusion coating a polyolefin resin without providing a reinforcing layer or after providing a reinforcing layer on the cross-linked insulator to form the jacket and irradiating the jacket with electron beam.

In a preferred embodiment, this invention provides a process for preparing a high voltage-ignition cable having a low electrostatic capacity wherein the polyolefin resin used in the insulator layer is a polymer blend of polyethylene and a non-crystalline polyolefin resin.

In another preferred embodiment, this invention provides a process for preparing an ignition cable having a low electrostatic capacity wherein the resistive conductor core is prepared by extrusion coating the semiconductive material on the circumferential surface of the tension member which is composed of an aromatic polyamide fiber bundle, and the core is finished to have an outer diameter of 1.2 mm or less.

Further preferred embodiments of this invention will be apparent from the following description with reference to the drawings.

DETAILED DESCRIPTION OF THE INVENTION

In order to suppress radio interference generated by ignition discharge, a core of an ignition cable is required to have a resistance of about 16 kΩ/m. In general, therefore, a core having a diameter of about 1.8 mm which is prepared by impregnating a glass fiber bundle with a carbon paint has been used.

When the diameter of the core prepared using the glass fiber bundle is reduced to lower the electrostatic capacity of the ignition cable, the core may be cut in the course of extrusion or vulcanization of the insulator layer, jacket, or the like. This makes the commercial production of such an ignition cable difficult.

Figure 1:
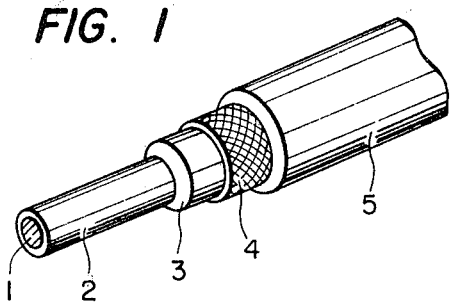
FIG. 1 is a perspective view of a high voltage-withstanding cable having a low electrostatic capacity which has a general construction to which the process of this invention is applicable.

The above defect encountered in the use of the glass fiber bundle can be overcome by using an aromatic polyamide fiber bundle of high strength as a tension member of the core. For example, as illustrated in FIG. 1, by impregnating a 1,500 denier aromatic polyamide fiber bundle 1 composed of, for example, "Kevler" (a trademark for a product by E. I. Du Pont de Nemours Co.) with a carbon paint 2 to provide a core having an outer diameter of from 0.9 mm to 1.2 mm, and providing on the thus-obtained core an insulator layer 3 comprising a cross-linked product of a composition consisting of polyethylene and a non-crystalline olefin polymer, a glass braid 4, and an ethylene-propylene rubber (EP rubber) or silicone rubber jacket 5, in that sequence, an ignition cable having a low electrostatic capacity of about 80 pF/m can be obtained. In order to obtain as low an electrostatic capacity as 80 pF/m or less, it is necessary to reduce the outer diameter of the core to 1.2 mm or less.

It has been found, however, that the thus-obtained ignition cable of a low electrostatic capacity suffers from the disadvantage that its high voltage-withstanding ability is unstable, and it is insufficiently durable for long and repeated use. That is, if an ignition coil voltage-withstanding test in which 30 KV of peak voltage was repeatedly applied to using an ignition coil, such an ignition cable is poor in high voltage withstanding ability.

As a result of extensive investigation to improve the poor high voltage withstanding ability, it has been found that the use of irradiation with electron beam upon cross-linking the insulator or jacket in place of conventional steam vulcanization shows a tendency of increasing high voltage withstanding ability and further that the use, as the insulator layer, of a polymer blend comprising crystalline polyethylene and a non-crystalline olefin polymer, e.g., EP rubber and an ethylene-α-olefin copolymer which is cross-linked by irradiation with electron beam, in place of the cross-linked polyethylene significantly increases the high voltage withstanding ability.

Such phenomenon as described above is very unexpected in those cables using an ordinary copper conductor. It is a common sense in the art that when comparing cross-linked polyethylenes, both polyethylenes cross-linked by steam vulcanization and those cross-linked by irradiation with electron beam show about the same high voltage-withstanding ability or the latter is slightly lower than the former in the high voltage withstanding ability.

Further, it is also a common sense in the art that a comparison of polyethylene alone with a polymer blend comprising polyethylene and EP rubber appears to indicate that the latter is lower in the high voltage withstanding ability than the former.

Irrespective of these facts, however, when the core comprises a resistive-conductor in place of copper conductor, those cross-linked by irradiation with electron beam gives much improved high voltage withstanding ability than those cross-linked by steam vulcanization even where polyethylene alone is used in the insulator layer of the ignition cable and further a significant increase in high voltage withstanding ability occurs when a polymer blend comprising polyethylene and EP rubber or an ethylene-α-olefin copolymer is cross-linked by irradiation with electron beam. These phenomena are very unexpected and by making use of them this invention provides an excellent ignition cable having a sufficiently low electrostatic capacity and a stabilized high voltage-withstanding ability.

This invention will be described with reference to the accompanying drawings.

In FIG. 1, reference numeral 1 indicates a tension member consisting of an aromatic polyamide fiber bundle, numeral 2 indicates a semiconductive paint layer, numeral 3 indicates an insulator layer, numeral 4 indicates a reinforcing layer, e.g., a braid layer, and numeral 5 indicates a jacket.

The dimensions of each element according to examples of this invention and comparative examples are shown in Table 1.

TABLE 1

Dimensional Construction of Low Electrostatic Capacity Ignition Cables

| | | Design I | | Design II | |
|---|---|---|---|---|---|
| Element | Material | Thickness (mm) | Outer Diameter (mm) | Thickness (mm) | Outer Diameter (mm) |
| Core | Aromatic Polyamide Fiber Bundle 1,500 denier × 1 | | 0.5 | | 0.5 |
| | Semiconductive Paint | 0.20 | 0.9 | 0.35 | 1.2 |
| Insulator | Polyolefin Resin | 1.85 | 4.6 | 1.80 | 4.8 |
| Reinforcing braid | Glass Yarn | 0.10 | 4.8 | 0.10 | 5.0 |
| Jacket | Olefin Resin | 1.1 | 7.0 | 1.00 | 7.0 |

On a 1,500 denier aromatic polyamide fiber composed of "Kevler" (a trade-mark for a product by E. I. Du Pont de Nemours Co.) there was repeatedly coated a semiconductive paint prepared by introducing a conductive substance, such as carbon black, graphite, silver, or copper power, into rubber, plastic or the like and drying the coated layers, such that the outer diameter was from 0.9 to 1.2 mm.

Next, in order to obtain the low electrostatic capacity, a low dielectric constant material, such as polyethylene, an ethylene-propylene copolymer (including an ethylene-propylene-diene terpolymer (EPDM), an ethylene-α-olefin copolymer, or blend polymers thereof, were extruded as an insulator, cross-linked by the electron beam irradiation method, and formed to have a diameter of 4.6 to 4.8 mm.

Then, a glass fiber braid was provided thereon as a reinforcing layer, and EP rubber or silicone rubber was extrusion-covered on the glass fiber braid. The outer diameter was finished to 7.0 mm. The formulation of the insulator used herein is described in Table 2.

TABLE 2

Composition of Insulator and Jacket

| Composition | Crystalline Polyethylene | EP | Toughmer A* | Cross-linking & Anti-aging Agents |
|---|---|---|---|---|
| A | 80 | 20 | — | slight |
| B | 60 | 40 | — | slight |
| C | 50 | 50 | — | slight |
| D | 80 | — | 20 | slight |
| E | 60 | — | 40 | slight |
| F | 50 | — | 50 | slight |
| G | 100 | — | — | slight |
| H | — | 100 | — | slight |

The electrostatic capacity and the ignition coil withstand voltage of the thus-obtained ignition cable measured are shown in Table 3.

The electrostatic capacity was measured according to JIS C-3004, the "Rubber Insulated Cable Testing Method," particularly, the sample was immersed in water, grounded, and the electrostatic capacity between the conductor and water was measured by the AC bridge method at a frequency of 1,000 Hz and expressed as a value per meter of the length.

Figure 2:
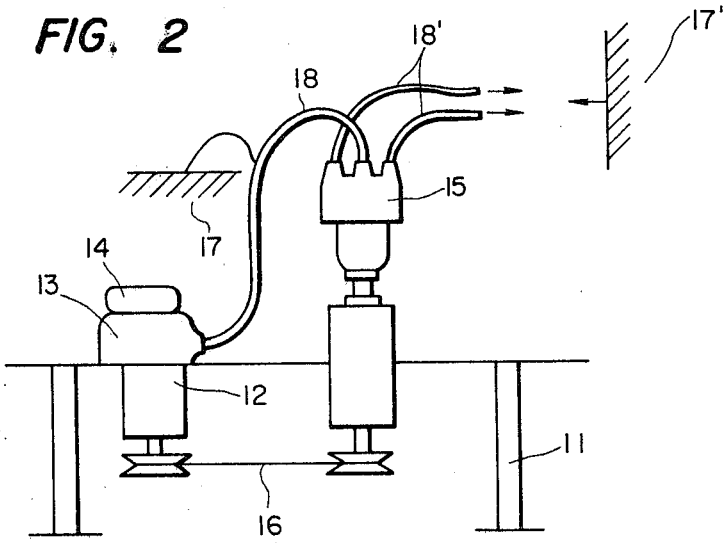
FIG. 2 is a diagrammatic representation of an apparatus for use in an ignition coil voltage-withstanding test.

FIG. 2 is a diagrammatic representation of an apparatus used in the ignition coil voltage-withstanding test, in which refering numeral 11 indicates a frame, numeral 12 a motor, numeral 13 a coil, numeral 14 an ignitor, numeral 15 a distributor (rotated at 1,000 rpm), numeral 16 a driving belt, numerals 17, 17' the ground, and numerals 18 and 18' ignition cables. The surface of the ignition cable is coated with a silver paint and grounded, and 30 KV is discharged in a needle gap provided between the conductor of the cable 18' and the ground 17'.

The results are shown in Table 3.

TABLE 3

| Characteristics of Low Electrostatic Capacity Ignition Cables | | | | | | | |
|---|---|---|---|---|---|---|---|
| | Construction | | | | | Electro-** static | |
| | Insulator | | Jacket | | | | |
| Example | Composition | Cross-Linking | Composition | Cross-Linking | Design | Capacity (pF/m) | High Voltage-Withstanding Test with Ignition Coil |
| 1 (Invention) | A | Irrad. | C | Irrad. | I | 70 | 2000 Hrs. OK for 5 samples |
| 2 (Invention) | A | Irrad. | C | Irrad. | II | 80 | 2000 Hrs. OK for 5 samples |
| 3 (Invention) | B | Irrad. | C | Irrad. | I | 71 | 2000 Hrs. OK for 5 samples |
| 4 (Invention) | C | Irrad. | C | Irrad. | I | 70 | 2000 Hrs. OK for 5 samples |
| 5 (Invention) | C | Irrad. | C | Irrad. | II | 80 | 2000 Hrs. OK for 5 samples |
| 6 (Invention) | D | Irrad. | C | Irrad. | I | 71 | 2000 Hrs. OK for 5 samples |
| 7 (Invention) | D | Irrad. | C | Irrad. | II | 79 | 2000 Hrs. OK for 5 samples |
| 8 (Invention) | E | Irrad. | C | Irrad. | I | 70 | 2000 Hrs. OK for 5 samples |
| 9 (Invention) | F | Irrad. | C | Irrad. | I | 69 | 2000 Hrs. OK for 5 samples |
| 10 (Invention) | F | Irrad. | C | Irrad. | II | 78 | 2000 Hrs. OK for 5 samples |
| 11 (Invention) | G | Irrad. | C | Irrad. | I | 68 | 18 Hrs BD for 1 sample and 2000 Hrs OK for 4 samples |
| 12 (Invention) | G | Irrad. | C | Irrad. | II | 78 | 27 Hrs BD for 1 sample and 2000 Hrs OK for 4 samples |
| 13 (Comparison) | G | Steam Vulcaniz. | H | Steam Vulcaniz. | I | 69 | 2–30 Hrs BD for 3 samples and 2000 Hrs OK for 2 samples |
| 14 (Comparison) | G | Steam Vulcaniz. | H | Steam Vulcaniz. | II | 78 | 5–29 Hrs BD for 4 samples and 2000 Hrs OK for 1 sample |

Note **:
Jis C-3004-1975 "Rubber Insulated Cable Testing Method"
OK: Good,
BD: Breakdown
"Irrad." means "irradiation with electron beam".
Steam Vulcaniz." means"steam vulcanization".

As will be apparent from the results shown in Table 3, although each example and each comparative example satisfy an electrostatic capacity of 80 pF/m and are all alike in this respect, the irradiation with electron beam is superior to steam vulcanization as a cross-linking method and a polymer blend comprising crystalline polyolefin, for example, polyethylene and non-crystalline polyolefin, for example, EP rubber or ethylene-$\alpha$-olefin copolymer such as Toughmer (a trademark for ethylene-4-methylpentene-1 copolymer produced by Mitsui Petrochemical Industries Limited), etc., is superior to polyolefin alone.

The reason why excellent high voltage withstanding ability is obtained in this invention is believed to be ascribable to the fact that in contrast to cross-linking by steam vulcanization which causes the surface of the core to sink due to heat and pressure applied during the cross-linking thus making the surface irregular (although when using a copper conductor sinking of the conductor will not occur), cross-linking by irradiation with electron beam gives rise to an article with a resistive conductor core having a smooth surface even when using a resistive conductor core which would otherwise suffer deformation due to heat and pressure upon cross-linking.

The ignition cable according to the invention having low electrostatic capacity is excellent in preventing problems caused by salts in a cold district, etc.

In this invention, aromatic polyamide fiber bundles as tension members may be twined or intertwined around a central aromatic polyamide fiber bundle. The resistive conductor core may be a tension member coated with only a semiconductive paint repeatedly and dried, or a tension member having thereon a semiconductive paint layer and provided thereon a stripping layer, and an extrusion coated rubber or plastic semiconductive material layer in multiple layers. As a material for preparing the stripping layer can be used a silicone paint which comprises silicone and a semiconductive paint prepared by mixing a conductive substance such as carbon, graphite, silver or copper powder with rubber or plastic.

Furthermore, the reinforcing layer may be a perforated tape, etc., as well as the braid, and may be provided between internal and external jacket, or the reinforcing layer may be omitted if desired.

While the invention has been described in detail and with reference to specific embodiments thereof, it will be apparent to one skilled in the art that various changes and modifications can be made therein without departing from the spirit and scope thereof.

What is claimed is:

1. A process for preparing a high voltage ignition cable having a low electrostatic capacity comprising a resistive-conductor core, an insulator layer and a jacket, which comprises preparing a resistive conductor core comprising a tension member consisting of a fiber bundle and a semiconductive material provided on at least on the circumferential surface thereof, extrusion coating a polyolefin resin comprising a polymer blend of polyethylene and a non-crystalline polyolefin on the circumferential surface of the resistive-conductor core to form an insulator layer, irradiating the insulator layer with an electron beam to effect cross-linking of the resin, extrusion coating a polyolefin resin, without providing a reinforcing layer or after providing a reinforcing layer, on the cross-linked insulator to form the jacket and irradiating the jacket with an electron beam.

2. The process as claimed in claim 1, wherein the non-crystalline polyolefin is an ethylene propylene rubber.

3. The process as claimed in claim 1, wherein the non-crystalline polyolefin is an ethylene-$\alpha$-olefin copolymer.

4. The process as claimed in claim 3, wherein the ethylene-$\alpha$-olefin copolymer is an ethylene-4-methylpentene-1 copolymer.

5. The process as claimed in claim 1, wherein the resistive-conductor core is prepared by extrusion coating a semiconductive material on the circumferential surface of the tension member comprising an aromatic polyamide fiber bundle to an outer diameter of 1.2 mm or less.

6. The process as claimed in claim 1, wherein the resistive-conductor core is prepared by coating a carbon paint on the tension member comprising an aromatic polyamide fiber bundle, drying the coated tension member, providing a stripping layer thereon, and extrusion coating a rubber or plastic semiconductive layer on the stripping layer, said resistive-conductor core being finished to have an outer diameter of 1.2 mm or less.

* * * * *